United States Patent [19]

Jeter

[11] Patent Number: 5,020,609

[45] Date of Patent: Jun. 4, 1991

[54] ACCELERATION COMPENSATING SYSTEM

[76] Inventor: John D. Jeter, 1403 Teche Dr., St. Martinville, La. 70582

[21] Appl. No.: 492,901

[22] Filed: Mar. 12, 1990

[51] Int. Cl.[5] ..... E21B 7/00

[52] U.S. Cl. ..... 175/48; 175/57; 175/320

[58] Field of Search ..... 175/48, 320, 324, 57, 175/24, 65

[56] References Cited

U.S. PATENT DOCUMENTS

| | | | |
|---|---|---|---|
| 2,964,116 | 12/1960 | Peterson | 175/48 |
| 3,294,170 | 12/1966 | Warren et al. | 166/264 X |
| 3,964,555 | 6/1976 | Franklin | 175/320 X |
| 4,531,579 | 7/1985 | Larronde | 166/66 |
| 4,678,045 | 7/1987 | Lyons | 175/100 X |
| 4,802,150 | 1/1989 | Russell et al. | 175/48 X |

*Primary Examiner*—Hoang C. Dang

*Attorney, Agent, or Firm*—John D. Jeter

[57] ABSTRACT

In the preferred application, an acceleration compensation mass is supported in a downhole drilling related housing for independent movement along an axis in response to acceleration of the housing. A control member that moves relative to the housing in a direction parallel the axis to carry out the function of the housed apparatus is connected to a piston in a cooperating bore in the housing to displace fluid when the member moves. A second piston and cooperating bore in the housing is arranged to displace fluid when the mass moves. Fluid plumbing is arranged to connect the two hydraulic cylinders such that the mass and the member, if they move, must move in unison in opposite directions. When the housing is accelerated in the direction along the axis, both member and mass tend to move in the opposite direction relative to the housing but each piston opposes the other and no movement occurs if the pistons have effective areas proportional to the weights of the related member and mass. The member, however, can move irrespective of acceleration reaction forces in response to force applied to it relative to the housing, with the mass moving a proportional amount in the opposite direction.

Alternate embodiments include linear compensators with the mass and member connected by racks and pinions to compel the opposite direction movements and a rotary compensator includes a rotating compenator mass rotationally connected to the member by gearing to compel rotation in opposite directions relative to the housing.

15 Claims, 3 Drawing Sheets

FIG. 7
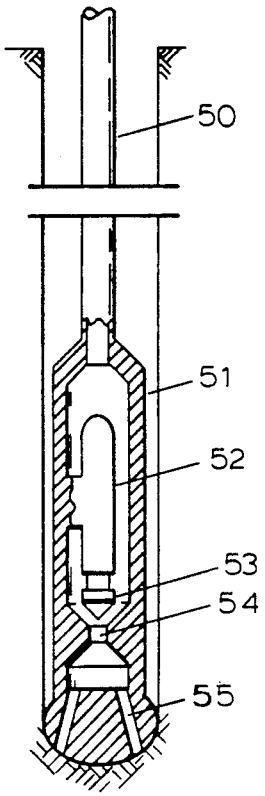
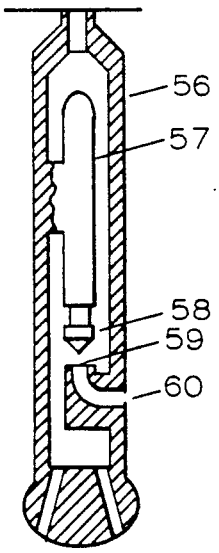
FIG. 8
FIG. 9
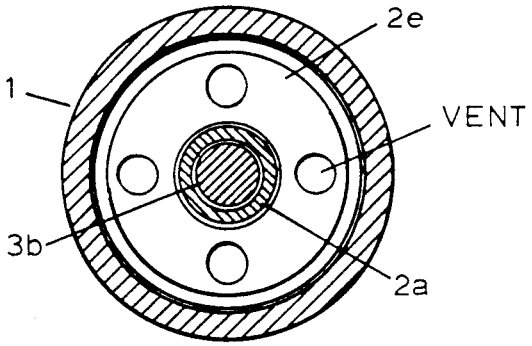
FIG. 10
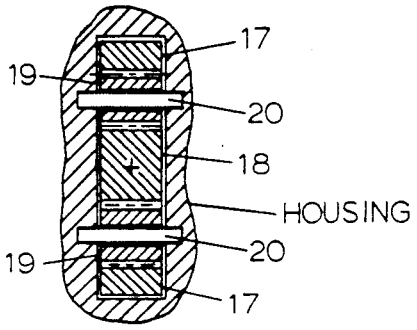
FIG. 11
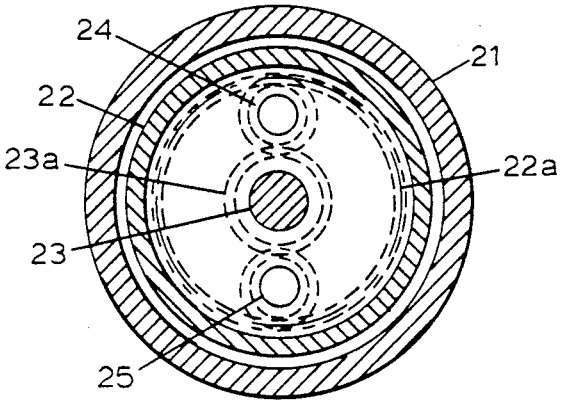

ACCELERATION COMPENSATING SYSTEM

This invention pertains to apparatus usable to compensate for acceleration reaction forces to preserve the functional integrity of elements of machinery that must accept deliberate movement but avoid accidental movement in a vibration and shock environment. Emphasis is directed to compensation for use in drilling related apparatus used downhole on drill strings and the like.

BACKGROUND OF THE INVENTION

The solenoid used in a housing, subject to vibration, to move a machine element on command and bold the selected position when acceleration forces urge it to move relative to the housing represents the typical problem area to which apparatus of this invention is directed. The solenoid armature and the payload it is expected to move represents mass. If the housing is subjected to a displacing acceleration in a selected direction, the stated mass tends to move in the opposite direction relative to the housing. If the mass moves in response to the acceleration it may produce erroneous movement of switches, valves, and the like.

If adequate space and power are available there are many ways to prevent unwanted acceleration induced movement. Brakes, detents, viscous damping, holding magnets and various secondary latching systems can be used. When power and space are limited, compensation becomes more important. Constant drag brakes require power to overcome when purposeful movement is required. Even if mass restraining devices can be released in preparation for intended movement the acceleration may impose added burden if the direction to be moved is against acceleration forces. If timing is critical, movement against acceleration forces in one actuation and with acceleration forces in the next actuation may result in prohibitive timing variances.

The small instrument systems used in drill strings in wells being drilled, for the purpose of measurement while drilling communication, have forced the compensation matter to attention. For many years apparatus bas been needed to compensate for the displacement forces imposed upon movable elements in a machine subject to acceleration forces. Apparatus of this invention effectively doubles the mass of the element to be purposefully moved against acceleration forces and retained in selected positions irrespective of such forces but otherwise protects against influence of acceleration of the host machine and defines the principal object of this invention It is therefore an object of this invention to provide apparatus for use in vibration and shock environment to enable control elements having weight to function without excessive influence from the resulting acceleration reaction forces.

It is another object of this invention to provide acceleration compensator assemblies for use in apparatus used downhole in drilling operations to reduce the influence of acceleration forces upon activity control machine members.

It is yet another object of this invention to provide well bore communication drilling fluid pressure change generators with acceleration compensation apparatus to prevent erroneous signal generation resulting from acceleration reaction caused by shock and vibration.

These and other objects, advantages, and features of this invention will be apparent to those skilled in the art from a consideration of this specification, including the attached claims and appended drawings.

SUMMARY OF THE INVENTION

A movable machine element, defined as a payload, is movable along a selected axis in a supporting frame. A seismic mass, also movable in a direction parallel the axis, is coupled to the payload such that the product of the payload velocity and its' weight equals the product of the weight of the mass and its' velocity. When the frame, supporting both mass and payload, is subjected to an acceleration along the axis, both payload and mass tend to move relative to the frame in a direction opposite that of the acceleration. By way of the coupling, both payload and mass subject each other to the same restraining force relative to the frame, in the axial direction, as if locked relative to the frame. Unlike a locking device, however, the opposed mass and payload may both move, in opposite directions, along the axis in response to force applied to the payload only.

In the preferred embodiment, the housing of a drilling related device used downhole near the drill head carries a valve control rod movable along the axis of the housing. The seismic mass equals the weight of the rod (payload) B and all directly coupled elements. The mass comprises a first piston situated in a bore in the housing serving as a hydraulic cylinder. The payload comprises a second piston operating within a bore in the first piston, both pistons are exposed to the fluid in the cylinder. The pistons have equal effective areas. Downhole hydrostatic head prevents cavitation and only one piston face is required for each movable weight. The preferred form need only compensate for accelertion of short duration and absolute seals are not needed on the pistons. To prevent downward drift of the unsealed mass piston springs are used to oppose the effect of gravity. The control rod is moved for the intended use by a solenoid. The solenoid has to move twice as much mass as the payload alone represents and the required energy is about doubled but in an environment that can experience on hundred G accelertion the force economy is evident.

The compensator system for rotational accelaration embraces the same principles involved in the linear compensators. A payload weight and a compensating mass are movable about an axis and the two are coupled such that, if they move, they move in opposite directions about the axis. The preferred coupling is spur gearing. An internal gear on the mass is coupled to an external gear on the payload by spur gear pinions on axles affixed to the frame. The common drive for the payload is an electric motor. The common payload includes a rotary hydraulic valve member that determines signal pulse timing in drilling related activities.

The hydraulic alternate embodiment includes two interconnected hydraulic motors. One motor is connected to the payload and the other is connected to the compensating mass. Hydraulic interconnects assure that the two motors move in opposite rotational directions.

Rotational accelertion delivered to the frame is transmitted to both movable bodies but their opposing reactions prevent acceleration induced movement of either body relative to the frame. Irrespective of acceleration of the frame, however, both bodies can be moved by an applied force and will react to the applied force as if no acceleration were imposed on the frame.

BRIEF DESCRIPTION OF DRAWINGS

In the drawings wherein like captions pertain to like features,

FIG. 7 is a generally schemetic side view, mostly cut away, of a well drilling arrangement in which apparatus of this invention may be applied.

FIG. 8 is a generally schematic side view, mostly cut away, showing a negative pulser arranged in a bottom hole assembly for well drilling.

FIG. 9 is a sectional view taken along line 9 of FIG. 1.

FIG. 10 is a sectional view taken along line 10 of in FIG. 3.

FIG. 11 is a sectional view taken along line 11 in FIG. 4.

DETAILED DESCRIPTION OF DRAWINGS

Figure 1:
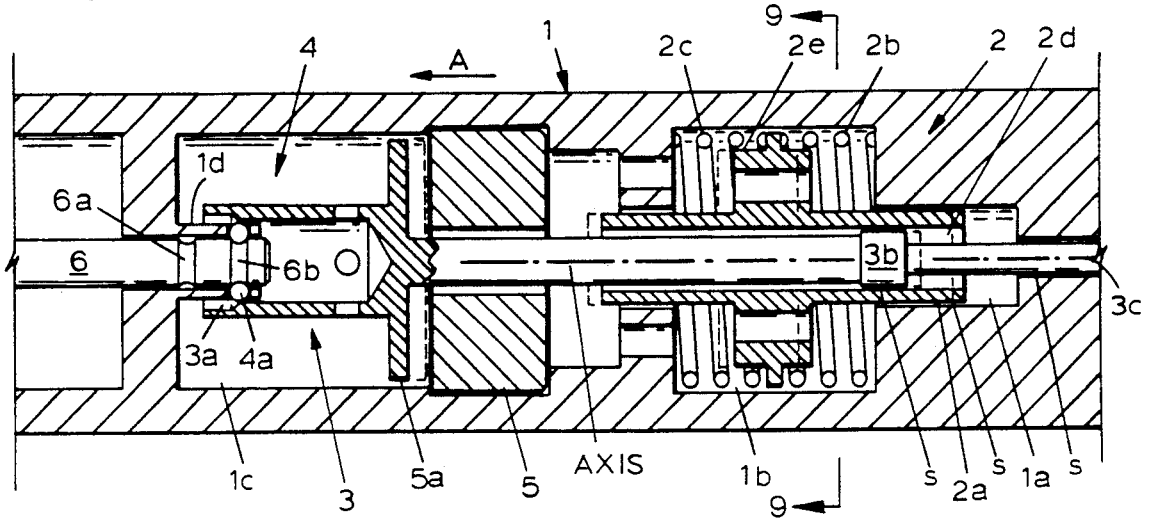
FIG. 1 is an elevation, in cut away, of the preferred embodiment of this invention.

In the drawings, wherein like features have the same captions, features pertaining to manufacturing and maintenance utility but not bearing upon points of novelty are omitted in the interest of descriptive efficiency. Many threaded junctures, retaining rings, and the like are not shown. Sliding surfaces that have at least some sealing effectiveness are captioned s. Sealing rings are not shown.

In FIG. 1 solenoid 5, lock assembly 4, and locked element 6 are not part of claimed matter and are shown to clarify the general purpose of the novel features. The host machine is a communication pulser used downhole in a drilling operation near a drill head that commonly produces intense vibration that is transmitted to the pulser. That vibration produces a tendency for movable elements within the pulser to move relative to the pulser housing (frame) and cause errors in pulse coded information. Those critical elements must move when intended for encoding and cannot be locked to the housing at those times. Power available downhole for operation of such features as solenoids is very limited. Radial space in the housing is very limited and conventional lock protecting features consume power, add complexity, and are prone to fail.

Housing 1 has openings 1*a* and 1*b* which contain the novel acceleration compensating features. The housing is cylindrical and has a general centerline or axis. Assembly 3 is the actuating assembly that is free to move axially in response to the force produced by solenoid 5 acting on solenoid armature plate 5*a*. Left is down in the practical apparatus. A spring, out of view to the right urges assembly 3 downward. When actuated by a signal from a downhole instrument, not shown, the solenoid moves assembly 3 upward to release lock 4 and allow rod 6 to move. Rod 6 is urged to move by associated machinery not shown and is biased by that machinery before the planned unlocking action. Rod 6 controls a pulser valve that produces the communication pulses and serves !he purpose of the pulser.

Assume that housing 1 is being accelerated downward as shown by arrow A. Normally, assembly 3 would tend to remain still and hence move upward relative to the accelerating housing. That would unlock lock 4 and allow rod 6 to move before solenoid actuation. Seismic mass 2*e*, in this case, has the same weight as assembly 3 and would tend to move upward with the same force as assembly 3. Annular piston 2*a*, part of the seismic mass, is seallngly situated in bore 1*a*. Piston 3*b* has an annular piston surface of the same area as piston 2*a* and is sealingly situated inside bore 2*d*. The upward force of assembly 3 and mass 2*e* is opposed by fluid in bore la and neither can move relative to the housing in response to the acceleration reaction. With the acceleration in effect, however, solenoid 5 can apply an upward force on plate 5*a*. Piston 3*b* can move and displace fluid, normally oil and cause piston 2*a* to move down a corresponding amount. Intense accelerations in drill strings are normally of brief duration and positive seals are usually not required on pistons 2*a*and 3*b*. Close fit and some leakage is usually acceptable. Springs 2*b* and 2*c* suspend mass 2*e* in the general center of available axial travel of the mass. Cams 3*a* allow lock balls 4*a*, which are in radial bores in nipple 1*d*, to move outward to release rod 6 which can move upward to carry out the intended action in the pulser. The lock balls, having been released from groove 6*b* will move to engage groove 6*a* when the solenoid releases assembly 3 to move downward.

Assembly 3 is the timing feature shown to be compensated for acceleration effects yet free to move when directed by the solenoid. The acceleration may exceed one hundred times gravity acceleration and the effect can damage locks such as lock 4. Rod 6 can be similarly compensated by a seismic mass much as shown for assembly 3. If exact compensation is needed, the related weights must have piston areas proportional to the associated weights. Otherwise stated, the product of the weights and their distance of corresponding travel must be equal. Vibration is often useful for breaking friction in sliding surfaces and exact compensation may not be desired. A preferred reaction to acceleration may be retained by selectively mis-matching the products of weights and related movements.

The apparatus of FIG. 1 operates downhole where hydrostatic head prevents cavitation and one piston face can reliably convey forces in either direction.

FIG. 9, a sectional view taken along line 9 of FIG. 1, further clarifies the preferred relative positions of the captioned elements.

Figure 2:
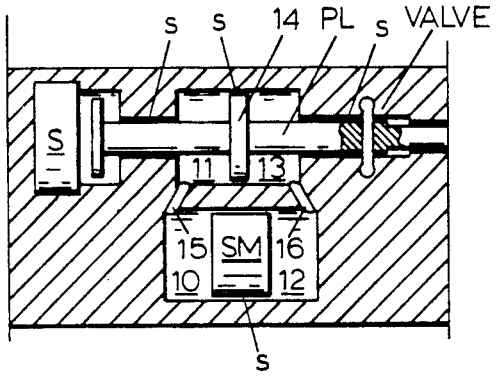
FIG. 2 is an elevation, in cut away, of a symbolized assembly similar to FIG. 1 showing opposed piston faces.

FIG. 2 the conceptual equivalent of FIG. 1 shows two piston faces for each movable mass. In the frame, payload PL has piston 14 sealingly slidable in a cylinder comprising chambers 11 and 13. The seismic mass SM is sealingly slidable in a cylinder comprising chambers 10 and 12. Chambers 10 and 11 are connected by a channel 15 and chambers 12 and 13 are connected by channel 16. The solenoid S and the valve are shown to define the purpose and are not part of the novel features If the frame is accelerated, the mass and payload will react in opposition as described for FIG. 1 and the purposeful movement induced by the solenoid is similarly enabled irrespective of the acceleration present. Two piston faces for each compensated weight are demonstrated.

Figure 3:
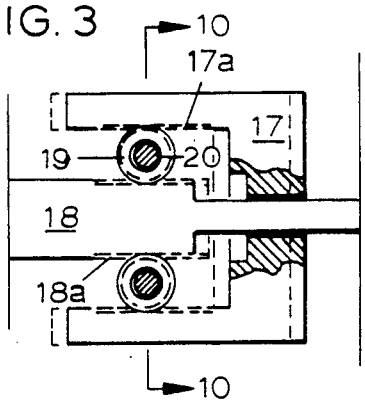
FIG. 3 is an elevation, partly cutaway, of a geared version of the principal compensator elements of the apparatus of FIG. 1.

In FIG. 3 seismic mass 17 is connected to payload 18 by pinions 19 which are free to rotate about axles 20 which are secured to the frame. The pinions engage gear racks 17*a* on the mass and gear racks 18*a* on the payload. The frame is omitted but if shown would include means to confine both mass and payload for movement along the housing axis as described for the apparatus of FIG. 1. The payload and mass are free to move if they move in opposite directions relative to the frame. The acceleration reactions are cancelled in the manner already described but purposeful movement of the payload is permitted irrespective of frame acceleration. The apparatus of FIG. 3 could directly replace the compensating features of FIG. 1. Mass 17 would replace mass 2. Member 18 would replace piston 3*b* and the pinions would replace the pistons and cylinder. The springs 2*a* and 2*c* would not be needed.

FIG. 10, a sectional view taken along line 10 of FIG. 3, further clarifies the preferred relative positions of the captioned elements.

Figure 4:
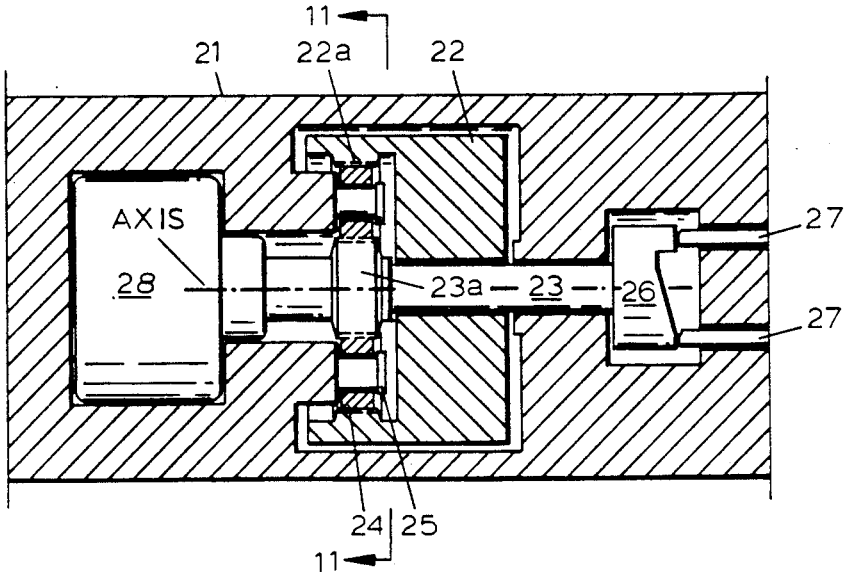
FIG. 4 is an elevation, mostly cut away, of a rotary version of the apparatus of FIG. 1.

In FIG. 4 the housing and situation are the same as that for FIG. 1. Rotational acceleration of the housing causes undesirable reactions of the rotationally movable parts within. In normal operation motor 28 rotates assembly 23 about the housing centerline to actuate cam 26 to operate cam followers 27 in a manner and timed sequence dictated by the purpose to be served by the apparatus. Acceleration of the housing can cause the cam to prematurely trip a follower and produce errors. The motor, cam and followers are not part of the invention and are used only for descriptive convenience. Seismic mass 22 is bearingly supported within the housing, in this case, on assembly 23. Pinions 24 are free to rotate about axles 25 which are secured to the housing. The pinions engage internal gear 22*a*on the mass and gear 23*a* on assembly 23. When motor 28 rotates assembly 23 mass 22 rotates in the opposite direction. Unless speed changing gears are used the mass and the payload 23 operate at different rotational speeds. If the ratio of the rotational moments of inertia of the mass and the payload are inversely proportional to the gear ratio as described in the summary herein rotational acceleration of the housing will not cause rotation of the payload relative to the housing. The reaction torque of mass and payload will exactly offset each other and the payload will behave as if locked to the housing. The payload will rotate relative to the housing, however, in response to torque applied by the motor irrespective of acceleration of the housing.

The linear acceleration compensating system disclosed herein can operate along any axis and can be combined with the rotational acceleration compensator to protect any sensitive element. Additionally, a single seismic mass can be connected to a plurality of individual components, even if distributed, provided the relative weights and speeds are considered. In FIG. 1, for instance, the payload 3 and rod 6 could have piston faces exposed to fluid piped from cylinder la to accomplish compensation even though rod 6 moves farther and faster than assembly 3. Plumbing and oil galleries are matters well established in the art.

FIG. 11, a sectional view taken along line 11 of FIG. 4, further clarifies the preferred relative positions of the captioned elements.

Figure 5:
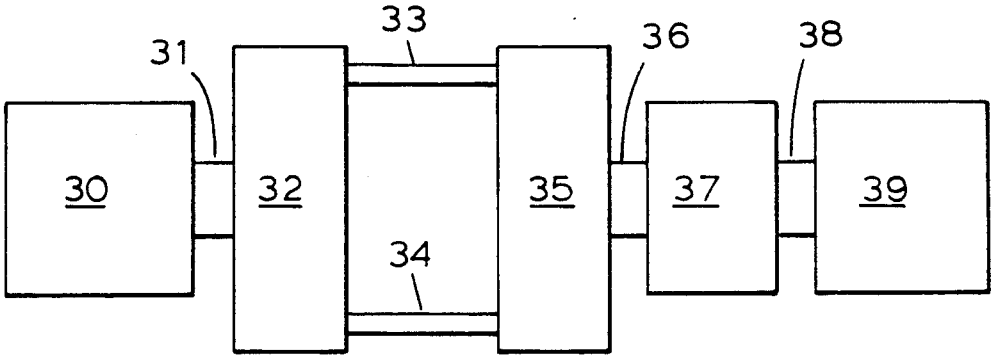
FIG. 5 is a layout in block form of an alternate version of a rotational acceleration compensator.

FIG. 5 shows two hydraulic motors 32 and 35 fluidly connected by tubes 33 and 34 such that the motors, if they turn, must turn in opposite directions. Bear in mind that hydraulic motors can be selected that serve equally well as motor or pump and can turn in either direction. These are such motors. Compensator weight 30 is rotationally connected to motor 32 by shaft 31 and all three rotate about the same axis. Motor 35 is rotationally connected to drive motor 37 by shaft 36 and to payload 39 by the continuing shaft 38, all operating on one axis. Motor 37 is the control input for the payload which may be a valve, cam assembly or the like to be protected. The oppositely rotating weight provides protection from the effects of rotational acceleration by processes previously described herein.

Figure 6:
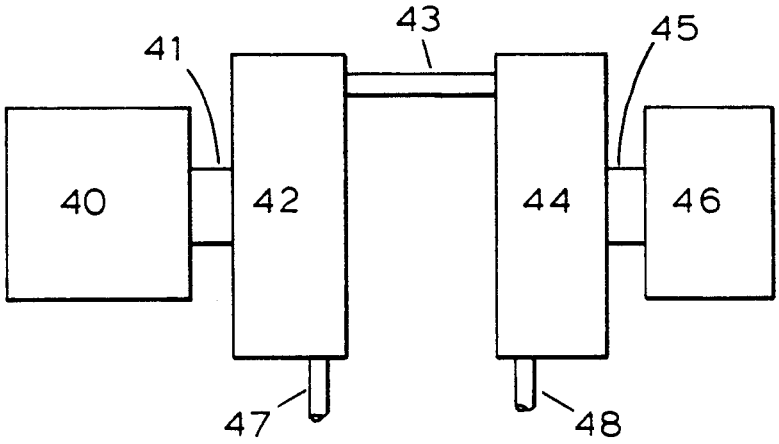
FIG. 6 is a layout in block form similar to FIG. 5 but utilizing and external fluid power source.

In FIG. 6 motors 42 and 44 are powered by fluid from a fluid power control source to operate payload 46. The motors are connected in series by tube 43 such that the motors run in opposite directions. Payload 46 is connected on the same axis to motor 44 and compensating weight 40 is connected on the same axis by shaft 41 to motor 42. By preference, both motors are identical and compensator weight 40 has the same rotational moment of inertia as the payload. The system can use different motor speeds, with the same fluid flow rate through both if the rotational moments of inertia of the payload and weight are inversely proportional, if exact compensation is desired. This arrangement prevents rotational acceleration of the apparatus from imposing fluid pressure reactions on the fluid powering source applied to tubes 47 and 48.

The compensating mass can be distributed within the operating elements of a design and FIG. 3 is a good example to use. Mass 17 can comprise the naturally heavy armature of a solenoid. Member 18 then could comprise the left tubular end of the lock 4 assembly of FIG. 1. By that process the compensated assembly can weigh no more than the uncompensated assembly would weigh. In essence, the linked machinery would be divided such that the sum total of the products of weight times speed of linked elements moving in one direction would approximate the sum total of the products of linked elements weight times speed moving in the opposite direction. This is anticipated by and is within the scope of the claims.

In the case of rotational acceleration compensation a gear train having counter rotating members on generally parallel axes invite the use of at least one of the train members as the member to be adjusted in rotational moment of inertia !o generally equalize the sum total of the products of moments of inertia and related speeds for the oppositely rotating set of train members. Preferably, some weight is added to a selected member. The rotating mass is effective in proportion to the rotational moment of inertia, not just the mass involved and may best be referred to as a counter moment member.

It is rather uncommon in many machines to have rigidly defined lines of action of acceleration. This is especially true of drilling activities because a rock bit normally has three cones with many teeth each. The teeth stumble about on a chipped drilling face. The result is often called thrust vector origin dance. Resulting acceleration includes rotational about an axis that generally trends toward the dancing vector rather than the drill string axis. Axial thrust variation is combined with changing bending moment in the drill string. In a single second the resultant linear acceleration collection of short life vectors would defy description. As used herein, the acceleration line of action and the acceleration axis may be regarded to be that component of acceleration chosen for compensation.

FIG. 7 shows drill string 50 supporting housing 51 in a well bore. Pulser 52 is supported in the housing and controls poppet 53 which cooperates with orifice 54 to function as a signal valve for creating communication pulses in a mud stream which flows down the drill string bore and out bit nozzles 55 to return up the well annulus. This is a conventional practice.

FIG. 8 shows a bottom hole arrangement similar to that in FIG. 7 but utilizing a negative pulser. Housing 56 supports pulser 57 which controls poppet 58 which cooperates with orifice 59 to control by-pass flow through channel 60. This is a conventional practice.

From the foregoing, it will be seen that this invention is one well adapted to attain all of the ends and objects hereinabove set forth, together with other advantages which are obvious and which are inherent to the method and apparatus.

It will be understood that certain features and subcombinations are of utility and may be employed without reference to other features and subcombinations. This is contemplated by and is within the scope of the claims.

As many possible embodiments may be made of the apparatus and method of this invention without departing from the scope thereof, it is to be understood that all matter herein set forth or shown in the accompanying drawings is to be interpreted as illustrative and not in a limiting sense.

The invention having been described, I claim:

1. An acceleration compensator for use downhole in apparatus used for drilling operations, to reduce acceleration reaction induced movement of elements within the apparatus, relative to the apparatus, when the apparatus is subjected to acceleration, the compensator comprising:

a) an apparatus housing having an axis and means for attachment to a drill string;

b) a member carried in said housing for movement relative to said housing in a general direction parallel to said axis, requiring movement to accomplish the purpose of the apparatus;

c) a compensator weight supported in said housing for movement generally parallel to said general direction;

d) coupling means supported in said housing and arranged to cooperatively function with said member and said weight such that, if they move, they move in unison in opposite directions relative to said housing with movement ratios such that the product of the mass of the effective weight to be compensated of said member times its distance moved during compensation approximate the product of the mass of said weight times its distance moved during compensation.

2. The compensator of claim 1 wherein said coupling means comprises a variable volume fluid chamber arranged to displace fluid in sympathy with said movement of said member fluidly connected to a second variable volume fluid chamber arranged to displace fluid in sympathy with said movement of said weight.

3. The compensator of claim 1 wherein said coupling means comprises a gear train including gears on said member and on said weight.

4. An acceleration compensating device suitable for use in downhole well drilling apparatus to reduce the influence of rotational acceleration of the apparatus, about an axis, upon at least one machine member mounted in the apparatus for rotation about a line generally parallel to the axis, the device comprising:

a) a compensator mass situated within the apparatus for rotation about a line generally parallel to said axis;

b) means for rotationally coupling said mass to said machine member such that said mass and said machine member rotate in opposite directions, if they rotate, with relative speeds such that the product of the effective rotational inertia to be compensated of said machine member times its rotational speed approximates the product of the rotational inertia of said mass times its rotational speed.

5. The device of claim 4 wherein said coupling means comprises a gear train.

6. The device of claim 4 wherein said coupling means comprises two hydraulic motors, one rotationally connected to said mass and one rotationally connected to said drive means, with fluid interconnections to cause the motors to rotate in opposite directions when they rotate.

7. An acceleration compensated signal pulse generating apparatus suitable for use downhole on a drill string in a well for communication with the surface by generating time distributed fluid pressure changes in a drilling fluid flowing along the bore of the drill string without generating erroneous signals when the apparatus is subjected to vibration and shock, the apparatus comprising:

a) a housing, having an axis and means for attachment to the drill string;

b) a pressure change generating signal valve, carried by said housing, arranged to variably resist the flow of drilling fluid to cause said pressure changes, with means for controlled actuation of said valve by movement of at least one member in both directions along a line parallel said axis;

c) an acceleration compensating mass situated in said housing for movement in both directions along a line parallel said axis;

d) a first fluid actuation chamber situated in said housing connected to said member to displace fluid in response to said movement;

e) a second fluid actuation chamber situated in said housing connected to said mass to displace fluid in response to said movement of said mass; and f) fluid communication means arranged to conduct fluid between said actuation chambers such that said member and said mass are caused to move in opposite directions relative to said housing, along said lines when either member or mass are caused to move.

8. The apparatus of claim 7 wherein said fluid actuation chambers comprise pistons sealingly situated within bores, one of said bores containing one of said pistons.

9. An acceleration compensated signal pulse generating apparatus suitable for use downhole on a drill string in a well for communication with the surface by generating time distributed fluid pressure changes in a drilling fluid flowing along the bore of the drill string without generating erroneous signals when the apparatus is subjected to rotational acceleration about an axis, the apparatus comprising:

a) a housing having means for attachment to a drill string;

b) a pressure change generating signal valve, carried by said housing, arranged to variably resist the flow of drilling fluid in the drill string to cause said pressure changes in response to rotation of at least one control member in said apparatus arranged for controlled rotation about a line generally parallel to said axis;

c) an acceleration compensating mass situated in said housing for rotation about a line generally parallel to said axis;

d) transmission means in said housing arranged to rotationally couple said control member and said compensating mass such that, if they rotate, both mass and member will rotate in directions at speeds relative to said housing such that the product of the rotational moment of inertia of said mass and the rotational speed of said mass will approximate the product of the rotational speed of said member and the effective rotational moment of inertia of said member and rotationally coupled control related members.

10. The apparatus of claim 9 wherein said transmission means comprises a gear train mounted on said housing and arranged to transmit rotational movement between said mass and said member.

11. The apparatus of claim 9 wherein said transmission means comprises a first hydraulic motor connected to said mass and a second hydraulic motor connected to said member, said two motors fluidly connected to cause said motors to rotate, if they rotate, in opposite directions.

12. A method for compensating for the effects of vibration and shock imposed upon downhole drilling related apparatus to prevent the effects of acceleration reaction from influencing the movement of a machine member, carried by the apparatus, which is movable along a line generally parallel the line of action of the acceleration, the method comprising the steps:

a) providing a counterweight member movable along a line generally parallel said line of action;

b) coupling said counterweight member to said machine member such that, if they move, they move in opposite directions; and c) arranging the weight of said counterweight member such that the product of the velocity times the weight of said machine member approximates the product of the weight times the velocity of said counterweight member, said velocities relative to the general apparatus.

13. The method of claim 12 wherein said machine member comprises a plurality of coupled movable machine members and said product of the velocity times the weight of said machine member comprises the sum of the product of velocity times the weight of each said coupled movable member.

14. A method for compensating for the effects of rotational acceleration imposed upon downhole drilling related apparatus to reduce acceleration reaction induced influence upon a rotatable machine member carried by the apparatus for rotation relative to the apparatus about an axis parallel a component of the rotational acceleration axis, the method comprising the steps:

a) providing a counter moment member carried for rotation relative to the apparatus, rotationally coupled to said rotatable machine member for rotation in the opposite direction about an axis generally parallel said acceleration axis; and b) arranging the rotational speed and weight distributions such that the product of rotational speed times the rotational moment of inertia of said counter moment member approximates the product of rotational speed times the rotational moment of inertia of said rotatable machine member, said moments of inertia relative to the axis of rotation of the respective members.

15. The method of claim 14 wherein said counter moment member is part of a gear train selected to serve the counter moment function.

* * * * *